United States Patent [19]

Detrick

[11] 4,266,755

[45] May 12, 1981

[54] FASTENER EXTRACTING APPARATUS

[76] Inventor: Jeffrey C. Detrick, P.O. Box 3155, Shawnee, Kans. 66203

[21] Appl. No.: 57,729

[22] Filed: Jul. 16, 1979

[51] Int. Cl.[3] ..... B66F 15/00

[52] U.S. Cl. ..... 254/18

[58] Field of Search ..... 254/18; 227/63

[56] References Cited

U.S. PATENT DOCUMENTS

| | | |
|---|---|---|
| 1,840,858 | 1/1932 | Titus . |
| 2,260,767 | 10/1941 | Black et al. . |
| 2,446,741 | 8/1948 | Chidakel . |
| 2,522,769 | 9/1950 | Anderson . |
| 2,570,914 | 10/1951 | Buck . |
| 2,735,649 | 2/1956 | Swallert . |
| 3,038,701 | 6/1962 | Sainio . |
| 3,069,707 | 12/1962 | Harper ..... 227/63 X |
| 4,078,766 | 5/1978 | Saurwein . |

*Primary Examiner*—Robert C. Watson

*Attorney, Agent, or Firm*—Fishburn, Gold and Litman

[57] ABSTRACT

An apparatus for extracting a fastener, such as a nail, imbedded in a workpiece, such as a board. The apparatus includes an upright stand with a workpiece support table and a power ram actuated head mounted over the support table for forcing a projecting fastener end downwardly and dislocating a fastener head outwardly of the workpiece. A puller structure mounted below the support table is connected to a second power ram for swinging movement toward and away from the workpiece and the support table. The puller structure carries opposing grippers or jaw members extending upwardly toward the support table and connected to a third power ram for opening and closing the grippers or jaw members and seizing a fastener head therebetween. When the puller structure swings downwardly, the fastener is pulled from the workpiece.

9 Claims, 8 Drawing Figures

FASTENER EXTRACTING APPARATUS

This invention relates to devices for extracting nails and other fasteners and particularly to such devices which will extract nails from lumber without unnecessary tearing, splintering or splitting of the lumber and deformation of the nails.

With the escalating prices and increasing scarcity of lumber, it has become desirable and economical to reclaim and salvage lumber from houses, packing crates, pallets and the like, which lumber frequently contains nails or other fasteners that must be removed in order to salvage the lumber for reuse.

Where large amounts of material are involved, the removal of nails by manual pulling is laborious and time consuming and thereby vastly increases the cost of reclamation. Various fastener and nail pulling machines have heretofore been used, but have not been satisfactory because of large gouges and gashes produced in the lumber creating an unsightly appearance and adversely affecting structural strength. Moreover, many such nail pullers mangle the nails as they are extracted and render them unsuitable for reuse.

The principal objects of the present invention are to provide an apparatus for extracting fasteners that overcomes the above mentioned difficulties; to provide such an apparatus which does not gouge, gash or split lumber in extracting fasteners therefrom; to provide such an apparatus which operates steadily and faster than manual methods; to provide such an apparatus which is relatively portable and can be readily transported to a job site; to provide such an apparatus which substantially obviates any element of danger to a worker engaged in removing nails from salvaged lumber; to provide such an apparatus which leaves extracted nails in condition for reuse; to provide such an apparatus having a movable head which partially removes fasteners such as nails imbedded in a board; to provide such an apparatus having members operable to grip and seize a nail; to provide such an apparatus having a frame with side plates carrying the gripping members and operable for pulling a nail downwardly and away from a board; to provide such an apparatus which is adaptable to fully automatic operation as part of a production line; and to provide such an apparatus which is sturdy and efficient in use and particularly well adapted for the intended purpose.

Other objects and advantages of this invention will become apparent from the following description taken in connection with the accompanying drawings wherein are set forth, by way of illustration and example, certain embodiments of this invention.

Figure 1:
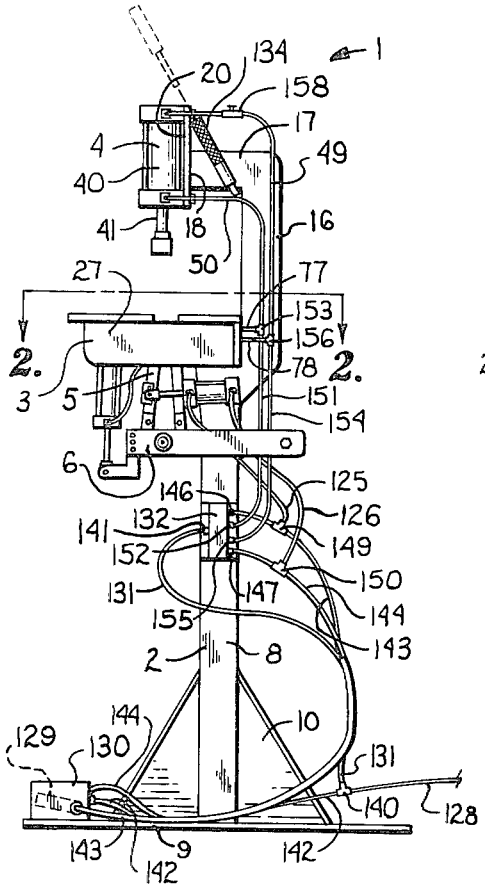
FIG. 1 is a side elevational view of an apparatus for extracting fasteners embodying the present invention.
Figure 2:
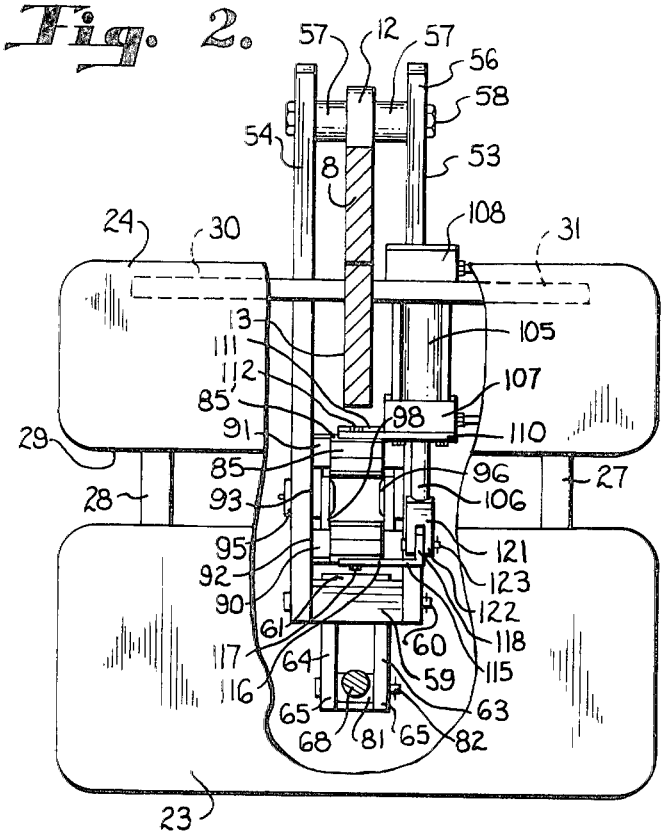
FIG. 2 is a transverse, sectional view taken along lines 2—2, FIG. 1 and having portions of a table broken away to shown structure thereunder.
Figure 3:
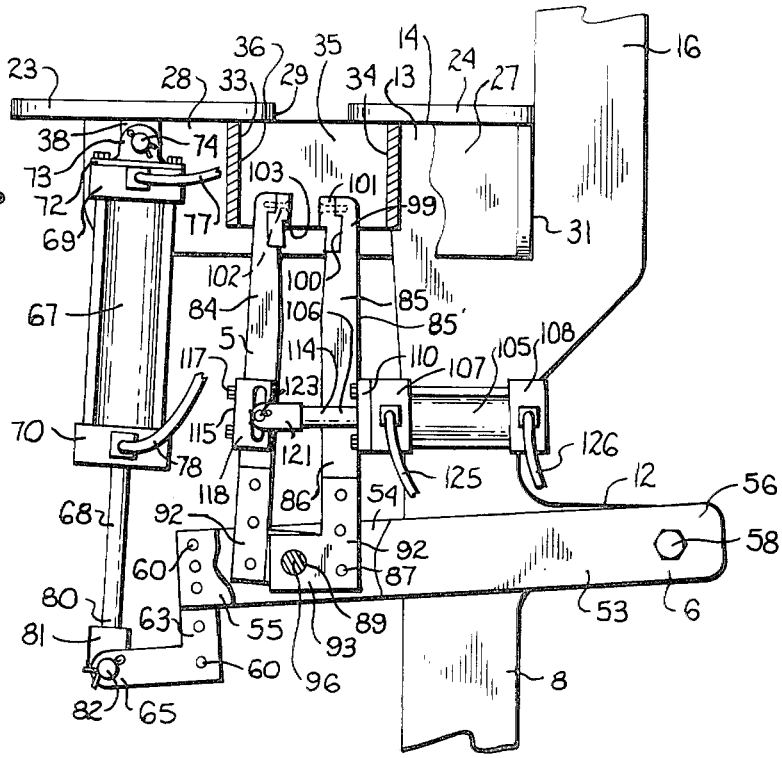
FIG. 3 is a fragmentary view and showing portions of the apparatus for seizing and extracting a nail.
Figure 4:
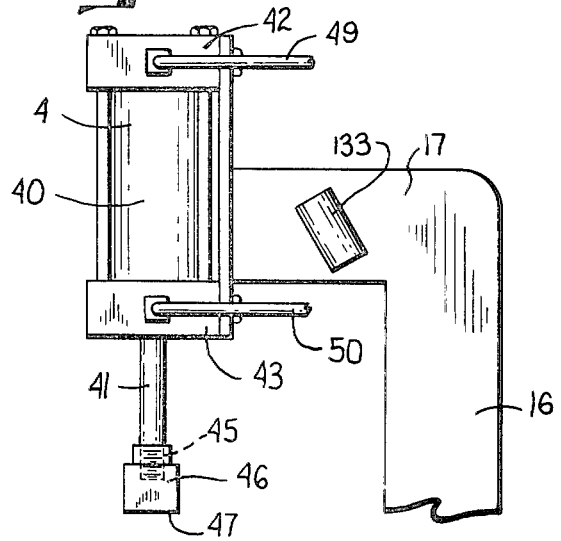
FIG. 4 is an enlarged, fragmentary view of a ram and movable head of the apparatus.

Referring to the drawings in more detail:

As required, detailed embodiments of the present invention are disclosed herewith, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates an apparatus for extracting a fasteners embodying the present invention and including a support member or standard 2 with a workpiece support table 3 extended outwardly thereof. A plunger structure 4 is mounted to upper portions of the support member or standard 2 and over the support table 3 for engaging a fastener end projecting from a workpiece, such as a board, and forcing a fastener head downwardly and outwardly of the board. The fastener head extends between opposed grippers or jaw members 5 positioned below the support table 3 and carried by a puller structure 6 swingably mounted to the support member or standard 2.

The exemplary support member or standard 2 includes a stand 8 having a floor engaging base 9 and braces 10 extending between the stand 8 and the base 9 for structural strength. An arm 12 extends rearwardly from an intermediate portion of the stand 8 for a purpose later described. On an intermediate portion on a forward side of the stand 8 and near the arm 12 is a table support portion 13 having a horizontal upper edge 14 for connection of the support table 3 as described below. A vertical arm portion 16 extends upwardly of the table support portion 13 and joins a horizontal carrier or arm 17 having a termination or end 18 normal to the longitudinal axis thereof. An elongate, vertical mounting plate is secured to the end 18, as by welding, for connection to the plunger structure 4 as described below.

The support table 3 provides a surface for resisting downward force of the plunger structure 4 upon a workpiece or board with a projecting nail tip or point and to that end includes horizontal, coplanar, front and rear plates 23 and 24 having lower surfaces 26 interconnected, as by welding, by transverse beams 27 and 28. The front and rear plates 23 and 24 are preferably parallel and spaced to form an elongate, open channel 29 for receipt of projecting fastener portions. A midportion of the rear plate 24 is secured, as by welding, normally to the horizontal upper edge 14 of the table support portion 13 and side beams 30 and 31 extend laterally of the table support portion 13 and are respectively connected to the rear plate lower surface 26 and ends of the transverse beams 27 and 28.

Providing further connection between the support table 3 and the table support portion 13, an open, rectangular, receptacle 33 underlies a central portion of the support table 3 and channel 29 and has a rear wall 34 secured to the lower surface 26 of the rear plate 24 and to a forward edge of the table support portion 13, as by welding. Receptacle side walls 35 are connected normally to the lower surface 26 and to the rear wall 34 and extend across the channel 29 to a front wall 36 mounted normally to the lower surface 26 of the front plate 23. As described below, upper portions of the grippers or jaw members 5 are received within the receptacle 33 to correctly position same for grasping a fastener. Positioned forwardly of the receptacle 33 and connected to the lower surface 26 of the front plate 24 is a hanger or ear 38 having a bore therethrough (not shown) for connection to portions of the puller structure 6.

The apparatus 1 includes actuatable components movably mounted above and below the workpiece support table 3 and in the illustrated example, the plunger structure 4 is mounted to the stand horizontal carrier or arm 17 so that a fastener projecting upwardly from a workpiece or board is pushed or moved downwardly. The exemplary plunger structure 4 includes an actuation means such as a first power ram 40 having an extensible and retractable first fluid actuatable piston rod 41 for reciprocatory movement toward and away from the workpiece support table 3. The ram 40 includes opposite end caps 42 and 43 fastened to the mounting plate 20, as by bolts 25, for affixing the plunger structure 4 to the stand 8 and normal to the workpiece support table 3.

A piston rod lower end 45 is adapted for detachable connection to a punch or head 46 having an end surface 47 generally planar and parallel to the support table top surface and preferably serrated, ridged or otherwise roughened with a non-skid texture for engagement of a projecting tip or end of a fastener to be extracted. To provide connection to a source of power fluid, described below, conduits 49 and 50 are connected to the ram 40 through the end caps 42 and 43 for extension and retraction. To accord with the maximum length of commonly used nails and other fasteners, the first piston rod 41 preferably has a four to five inch extension, or stroke, and extends to place the head end surface 47 slightly above the upper surface of the support table 3.

The puller structure 6 is swingably mounted below the workpiece support table 3 and carries the grippers or jaw members 5 to grasp and seize a fastener end and downwardly move away from the workpiece support table 3 to withdraw the fastener therefrom. In the illustrated example, the puller structure 6 comprises a carrier or frame connected to the arm 12 extending outwardly of the stand 8 and has elongate, parallel side plates 53 and 54 with respective front and rear ends 55 and 56. Rear ends 56 are swingably connected to the arm 12 by a pivot pin or bolt 58 extended through a bearing sleeve 57 in turn extended transversely through the arm 12 for spacing the side plates 53 and 54 for receipt of the grippers or jaw members 5, described below. Front ends 55 of the side plates 53 and 54 are connected in spaced relationship by a bar member 59 mounted therebetween, as by bolts 60, and having a lower or tongue portion 61 depending therefrom. Angle arms 63 and 64 having, in the illustrated example, a right angle, are connected to opposite sides of the lower or tongue portion 61, as by bolts 60, with front end portions 65 spaced apart and located forwardly and below the side plate front ends 55.

Actuation means, such as a second power fluid ram 67, includes a second extensible and retractable piston rod 68 for reciprocatory movement to swing the side plates 53 and 54 toward and away from the workpiece support table 3. The ram 67 includes upper and lower end caps 69 and 70, the upper end cap 69 being connected to a means for swingably suspending the ram 67 from the hanger or ear 38 on the lower surface 26 of the front plate 23. Such means includes a plate 72 having spaced, upwardly extending ears 73 for inserting the ear 38 therebetween and connecting thereto, as by a pin 74 so that the ram 67 generally depends normally to the workpiece support table 3. To provide power fluid for operation, extension and retraction conduits 77 and 78 are connected to the ram 67 through respective end caps 69 and 70. A lower end 80 of the piston rod 68 is connected to a head portion 81 having a bore therethrough (not shown) and positioned between the angle arm front end portions 65 for swinging connection thereto, as by a pin 82 permitting relative pivoting of the ram 67 and the side plates 53 and 54 as the latter swing about the pivot pin or bolt 58.

The grippers or jaw members 5 are carried by the puller structure 6 for up and down movement toward and away from the lower surface of the workpiece support table 3. In the illustrated example, front and rear, generally vertically extending arms 84 and 85 are positioned in side-by-side relationship and have respective lower ends 86 swingably connected to each other and to the spaced frame side plates 53 and 54. The arm lower ends 81 are connected to mating angle brackets arranged in pairs 90 and 91, each pair having a further pair of shank portions 92 each connected to opposite sides of an arm lower end 86, as by bolts 87. Legs 93 extend outwardly from respective shank portions 92, preferably at right angles therefrom. Preferably, the combined width of each of the arm lower ends 86 and a respective bracket pair 90 or 91 is substantially the same as the spacing between the frame side plates 53 and 54 for insertion and carriage therebetween and permitting relative swinging movement with minimal free play. In the illustrated example, the bracket pair 90 is mounted to the front arm 84 and in opposing relation to the bracket pair 91 mounted to the rear arm 85. The shank portions 92 of the front arm bracket pair 90 respectively have the legs 93 mounted to outside portions thereof and the shank portions 92 of the rear arm bracket pair 91 respectively have the legs 93 mounted to inside portions thereof for complementary fit of the bracket pairs 90 and 91.

The legs 93 of the bracket pairs 90 and 91 have bores 89 aligned therethrough and through the frame side plates 53 and 54 and pivot pins 95 and 96 are extended therethrough. Each pivot pin 95 and 96 connects one of the legs 93 from each bracket pair 90 and 91 to a respective frame side plate 53 and 54, thereby retaining a central opening 98 bounded by the front and rear arms 84 and 85 and the spaced legs 93 for extracted fasteners to fall through. The pivot pins 95 and 96 permit swinging movement of upper ends 99 of the front and rear arms 84 and 85 toward and away from each other to grasp and seize a fastener therebetween.

The exemplary arm upper ends 99 have recesses 100 therein and complementary, removable and replaceable jaw face inserts 101 secured thereto, as by screws 102, each jaw face insert 101 being adapted for grasping fasteners such as nails, staples or the like and in the illustrated example, having an overhanging catch or hook portion 103 to engage nail heads. The arm upper ends 99 extend upwardly and into close proximity of the channel 29 to grasp fastener ends extending therethrough. The front and rear walls 36 and 34 of the receptacle 33 limit outward swinging movement of the upper ends 99 and thereby retain the grippers or jaw members 5 in position for grasping a fastener.

Opening and closing pincher movement of the grippers or jaw members 5 is accomplished by actuation means such as a third power ram 105 having a reciprocable extensible and retractable piston rod 106. Preferably, the ram 105 extends transversely to the longitudinal, or generally vertical, axis of the front and rear arms 84 and 85 so that extension and retraction of the piston rod 106 causes the arms 84 and 85 to swing on the pivot pins 95 and 96 and move away from and toward each other. The third ram 105 has front and rear end caps 107 and 108, the front end cap 107 having a bar 110 connected thereto through which the piston rod 106 extends and including a side portion 111 mounted, as by bolts 112, to a rear side 85' of an intermediate portion of the rear arm 85.

A free end 114 of the piston rod 106 is swingably connected to the front arm by a bracket member 115 comprising, in the illustrated example, a bar 116 mounted to a front side 84' of the front arm 84, as by bolts 117, and a flange portion 118 extending rearwardly from the bar 116, such as at a right angle therefrom, and toward the piston rod free end 114. The flange portion 118 has a vertical slot 120 slidably engageable with a head 121 connected to the piston rod free end 114. The head 121 has spaced ears 122 for fitting the leading edge of the flange portion 118 therebetween and a pivot pin 123 is extended through the ears 122 and slot 120 for swinging connection and up and down sliding movement as the front and rear arms 84 and 85 swing toward and away from each other when the piston rod 106 reciprocates. Moreover, the ram 105 being mounted to the rear arm 85, moves forward and rearwardly therewith as the piston rod 106 retracts and extends. To provide power fluid for actuation, retraction and extension conduits 125 and 126 are connected to the ram 105 through end caps 107 and 108.

The power rams 40, 67 and 105 receive power from a source thereof, such as an air compressor, hydraulic pump or other suitable means. The exemplary rams are pneumatically actuated and it will be appreciated that electrical motors and actuation means, hydraulic means or the like can be used in suitable circumstances. In the illustrated example, a main power fluid line 128, carrying compressed air, leads from a source thereof (not shown) and connects to a Tee-fitting 140 having a line 131 extending to a front side port 141 of a valve means, such as a four-way flow regulator 132, such as manufactured by the Parker Valve Company, and mounted on the stand 8. A line 142 extends from the Tee-fitting 140 to a rear side of a foot actuated switch, such as a pedal 129 having a cover 130 partially enclosing same for protection against inadvertent actuation. The pedal 129 has internal valve arrangements (not shown) routing air from the line 142 to lines 143 and 144 extending from opposite sides of the pedal 129 and respectively connected to first and fourth ports 146 and 147 on a rear side of the flow regulator 132. The gripper or jaw member ram retraction conduit 125 is connected to the line 143 via a Tee-fitting 149 and the gripper or jaw member ram extension conduit 126 is connected to the line 144 via a Tee-fitting 150.

A conduit or line 151 is connected to a second port 152 in the flow regulator 132 and extends upwardly therefrom to a Tee-fitting 153 having the extension conduit 77 of the puller structure ram 67 and the retraction conduit 50 of the plunger structure ram 40 leading therefrom. A conduit or line 154 extends from a third port 155 of the flow regulator 132 and extends upwardly beside the line 151 to a Tee-fitting 156 having the retraction conduit 78 of the puller structure ram 67 and the extension conduit 49 of the plunger structure ram 40 leading therefrom. A valve 158 in the extension conduit 49 is provided for manually stopping flow of power fluid to the ram 40 and selectively preventing extension thereof.

The four-way flow regulator 132 has an internal arrangement of pressure responsive valves which open and close and direct power fluid to the rams via the various ports 146, 147, 152 and 155. When the foot pedal 129 is not actuated, power fluid is routed from the port 141 to the second port 152 to position the rams as described below in connection with FIG. 5. When the foot pedal 129 is actuated, the valves of the flow regulator route power fluid to provide sequenced actuation as described below in connection with FIGS. 6, 7 and 8.

Additionally, a holder 133 extends outwardly of the horizontal carrier or arm 17 of the stand 8 for storage of a nail straightening tool 134 having an open cylindrical end for insertion and straightening of bent over fastener or nail ends so that the fastener or nail can be pushed generally straight down and outwardly of the workpiece or board by the plunger structure 4.

Figure 5:
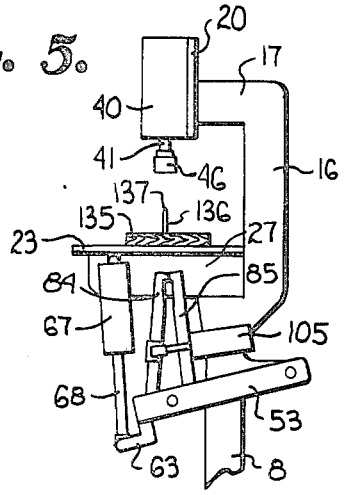
FIG. 5 is a fragmentary, diagrammatic view of the apparatus showing positioning of operational members preparatory to removing a nail from a board.
Figure 6:
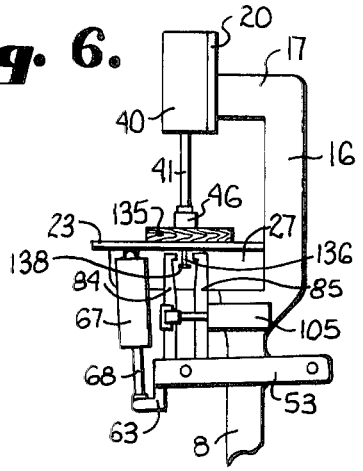
FIG. 6 is a fragmentary, diagrammatic view of the apparatus in a first operational position wherein the movable head is extended to push a nail head outwardly of the board.

In the use of the apparatus 1, FIGS. 5 through 8, a workpiece or board 135 is placed atop the support table 3 and a fastener imbedded therein, such as a nail 136, positioned so that a point or tip end 137 extends toward the head 46 of the plunger structure first power ram 40 and the nail head 138 overlies the open channel 29, FIG. 5. In preparation for extraction, the first piston rod 41 is retracted for ease of positioning the board 135 thereunder. The puller structure frame side plates 53 and 54 are swung downwardly and accordingly, the piston rod 68 of the second ram 67 is extended. The grippers or jaw members 5 are carried downwardly by the puller structure 6 and are closed. If the nail point or tip end 137 is excessively bent over, the nail straightening tool 134 is used to straighten the nail 136.

Operation of the apparatus 1 is initiated by pressing upon the foot pedal 129 to route air to the flow regulator 132 and to the rams 40, 67 and 105 in predetermined sequence. First, the piston rod 41 of the plunger structure 4 extends downward and, engaging the nail point or tip end 137 with the head end surface 47, forces downwardly upon same to push the nail head 138 outwardly of the lower surface of the workpiece or board 135 and through the open channel 29. The piston rod 68 of the puller structure 6 is retracted to swing the spaced frame side plates 53 and 54 upwardly and into a first position substantially parallel to the workpiece support table 3 and below the board 135. As the puller structure piston rod 68 retracts, the third ram 105 is actuated and the piston rod 106 extends to spread the front and rear arms 84 and 85 and thereby open the grippers or jaw members 5 and position each jaw face insert 101 on opposite front and rear sides of the nail head 138. As the grippers of jaw members 5 open, any fasteners held thereby and retained from previous extracting cycles are dropped and fall through the opening 98 to the floor or a convenient collection receptacle (not shown).

Figure 7:
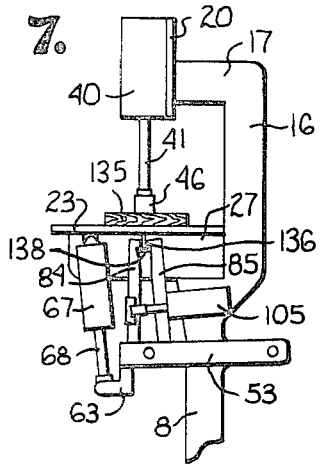
FIG. 7 is a fragmentary, diagrammatic view of the apparatus in a second operational position wherein grippers or jaw members are closed and grasping a nail to be extracted.
Figure 8:
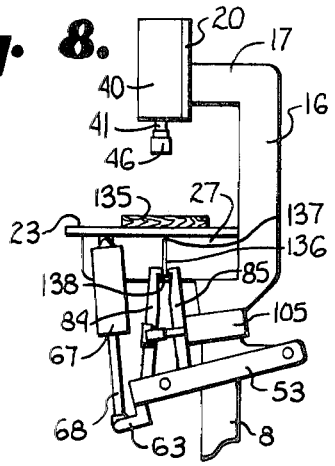
FIG. 8 is a fragmentary, diagrammatic view of the apparatus in a third operational position wherein the jaw members and assembly carrying same are moved downwardly to extract the nail from the board.

Next, FIG. 7, the third ram 105 is further actuated and the piston rod 106 retracted to swing the front and rear arms 84 and 85 together and seize the nail head 138 between respective jaw face inserts 101.

To extract the nail 136, the second ram 67 is actuated to extend the piston rod 68 and swing the spaced frame side plates 53 and 54 downwardly into a second position whereby the side plates 53 and 54 are no longer parallel to the workpiece support table 3. The grippers or jaw members 5 carried by the side plates 53 and 54 are accordingly moved downwardly and pull the nail 136 therewith and from the board 135. The piston rod 41 of the plunger structure 4 reciprocates upwardly in preparation for the next extracting cycle.

It will be appreciated that the apparatus 1 can be embodied in many and varied forms, including fully automatic forms comprising portions of pallet construction and reclamation devices and the like. Accordingly, while one form of the invention has been illustrated and described, it is not to be limited to the specific form or arrangement of parts herein described and shown, except insofar as such limitations are included in the following claims.

What is claimed and desired to secure by Letters Patent is:

1. An apparatus for extracting a fastener at least partially imbedded in a workpiece comprising:

(a) a support member;

(b) a workpiece support table supported by said support member and having opposite surfaces;

(c) a movable head and actuating means therefor mounted to said support member and in proximity to one surface of said support table and having reciprocatory movement toward and away from a fastener in a workpiece on said support table, said movable head actuating means having structure providing a pushing force of sufficient power to dislodge and push a portion of said fastener outwardly of said workpiece;

(d) a puller structure and actuating means therefor connected to said support member and in proximity to the other surface of said support table and having movement toward and away from said support table; and (e) opposing arms pivotally mounted to said puller structure and forming jaw members with actuating means operable to move said arms toward and away from each other and seize said portion of said fastener therebetween and pull said fastener from said workpiece when said puller structure moves away from said support table.

2. The apparatus set forth in claim 1 wherein:

(a) said movable head and actuating means therefor includes a power fluid actuatable ram with an extensible and retractable piston rod, said head being connected to said ram; and (b) said head has a generally planar end surface substantially parallel to said one surface of said support table with said end surface having non-skid means for engagement of said fastener.

3. The apparatus set forth in claim 2 wherein:

(a) said puller structure and actuating means therefor includes a frame with spaced side plates and having forward and rear ends, said rear ends being swingably mounted to said support member; and (b) said actuating means includes a power fluid actuatable ram with an extensible and retractable piston rod, said ram being swingably mounted to said forward ends of said side plates.

4. The apparatus set forth in claim 3 wherein:

(a) said puller structure ram extends outwardly of said support table and generally perpendicular thereto, said ram being connected to said side plates and operable to draw same into a first position substantially parallel to said support table when said piston rod is retracted and into a second position swung away from said support table when said piston rod is extended.

5. The apparatus set forth in claim 3 wherein:

(a) said opposing arms having upper and lower ends, said lower ends respectively having complementary legs extended therefrom and toward each other in side-by-side engagement, said legs having a pivot pin extended therethrough and through at least one of said side plates for swingably mounting said arms to each other and to said side plates.

6. The apparatus set forth in claim 5 wherein:

(a) said opposing arms have opposite sides with complementary pairs of said legs each extended outwardly from respective sides and in side-by-side engagement; and (b) each complementary pair of legs on respective sides of said arms have a pivot pin extended therethrough and through a respective side plate, thereby forming an opening between said complementary pairs of legs permitting movement of extracted fasteners therethrough.

7. The apparatus set forth in claim 5 wherein:

(a) said opposing arm upper ends have recesses with complementary removable jaw face inserts mounted therein for grasping said fastener.

8. The apparatus set forth in claim 7 wherein:

(a) said jaw face inserts respectively have hook portions in juxtaposed relationship.

9. An apparatus for extracting a fastener at least partially imbedded in a workpiece comprising:

(a) a support member;

(b) a workpiece support table supported by said support member and having opposite surfaces;

(c) a movable head and actuating means therefor mounted to said support member and in proximity to one surface of said support table and having reciprocatory movement toward and away from a fastener in a workpiece on said support table for pushing a portion of said fastener outwardly of said workpiece;

(d) a puller structure and actuating means therefor connected to said support member and in proximity to the other surface of said support table and having movement toward and away from said support table;

(e) opposing arms pivotally mounted to said puller structure and forming jaw members with actuating means operable to move said arms toward and away from each other and seize said portion of said fastener therebetween and pull said fastener from said workpiece when said puller structure moves away from said support table;

(f) said movable head and actuating means therefor including a power fluid actuatable ram with an extensible and retractable piston rod, said head being connected to said ram; and (g) said head having a generally planar end surface substantially parallel to said one surface of said support table with said end surface having non-skid means for engagement of said fastener.

* * * * *